US005400562A

United States Patent [19]

Bähr

[11] Patent Number: 5,400,562

[45] Date of Patent: Mar. 28, 1995

[54] SPACER FOR A REINFORCEMENT BAR TO BE EMBEDDED IN CONCRETE

[76] Inventor: Richard Bähr, Ringstr. 5, 89186 Illerrieden, Germany

[21] Appl. No.: 119,215

[22] PCT Filed: Jan. 25, 1993

[86] PCT No.: PCT/DE93/00070

§ 371 Date: Sep. 21, 1993

§ 102(e) Date: Sep. 21, 1993

[87] PCT Pub. No.: WO93/16248

PCT Pub. Date: Aug. 19, 1993

[30] Foreign Application Priority Data

Feb. 8, 1992 [DE] Germany ..... 9201584 U

[51] Int. Cl.[6] ..... E04C 5/16

[52] U.S. Cl. ..... 52/684; 52/677; 52/678; 52/687

[58] Field of Search ..... 52/677, 678, 684, 685, 52/686, 687; 248/73, 74.4

[56] References Cited

U.S. PATENT DOCUMENTS

| | | | |
|---|---|---|---|
| 2,257,421 | 9/1941 | Mabry | 52/678 |
| 2,867,041 | 1/1959 | McMillan | 52/677 |
| 3,006,115 | 10/1961 | Hillberg | 52/678 |
| 4,147,008 | 4/1979 | Eisner . | |
| 4,575,985 | 3/1986 | Eckenrodt | 52/686 X |
| 4,655,023 | 4/1987 | Yung . | |
| 4,835,933 | 6/1989 | Yung . | |

FOREIGN PATENT DOCUMENTS

| | | | |
|---|---|---|---|
| 634364 | 11/1963 | Belgium . | |
| 2303569 | 8/1973 | Germany | 52/678 |
| 2842426 | 4/1980 | Germany . | |
| 3804860 | 8/1989 | Germany . | |
| 466908 | 2/1969 | Switzerland . | |
| 1050089 | 12/1966 | United Kingdom . | |
| 1067503 | 5/1967 | United Kingdom . | |
| 1459662 | 12/1976 | United Kingdom | 52/684 |
| WO9001600 | 2/1990 | WIPO . | |

*Primary Examiner*—Carl D. Friedman
*Assistant Examiner*—Kevin D. Wilkens
*Attorney, Agent, or Firm*—Herbert Dubno

[57] ABSTRACT

A spacer for a reinforcement bar to be embedded in concrete has a band-like member adapted to wrap around and encircle the reinforcement bar and formed at its ends with a pair of screw parts with external formations which form a screwthread when the two parts are brought together to cause the band to encircle the reinforcing bar and a base with a correspondingly threaded bore at one end is threaded onto the resulting screw to cause the clamping member to seize the reinforcing bar and mount the base on the reinforcing bar.

10 Claims, 2 Drawing Sheets

SPACER FOR A REINFORCEMENT BAR TO BE EMBEDDED IN CONCRETE

CROSS REFERENCE TO RELATED APPLICATIONS

This application is a national phase of PCT/DE 93/00070, filed 25 Jan. 1993 and based, in turn, upon German national application G 92 01 584.0, filed 8 Feb. 1992, under the International Convention.

1. Field of the Invention

The invention relates to a spacer for reinforcement bars, such as may be required in concrete construction or in the production of prefabricated concrete components. Such spacers are necessary to ensure the required thickness of the concrete covering, because for the endurance of construction made of steel-reinforced concrete and prestressed concrete the thickness and compactness of the concrete covering are of decisive importance.

BACKGROUND OF THE INVENTION

As a rule, spacers for reinforced concrete consist of a base supported on the casing and a connection piece serving for attachment to the reinforcement bar. After the reinforcement for a concrete construction is finished, these spacers are fastened to the reinforcement bars along the outside of the reinforcement, so that the form boards to be positioned will have a preselected distance from the actual reinforcement element.

Such spacers have to meet a series of requirements. On the one hand, they should be cheap from the point of view of the material, as well as the manufacturing; on the other hand they have to be designed so that they can be quickly and securely fastened to the reinforcement rods by the reinforcement specialists, without the danger of their sliding or tilting during pouring.

2. Object of the Invention

It is the principal object of the present invention to provide an improved spacer for reinforcement bars which satisfies the requirements enumerated above and is free from drawbacks of earlier spacers.

SUMMARY OF THE INVENTION

According to the invention, such a spacer consists of a socket with a height corresponding to the desired distance of the bar from the face of the concrete body and a band-shaped clamping member which peripherally locks the reinforcement bar like a ring. The base has a threaded bore on its frontal side, while the two ends of the band-shaped clamping member are designed as parts of a screw with external threading fitting the threaded bore of the socket.

The handling of this spacer consisting of two parts is extremely simple. First the band-shaped clamping member which is already circularly preshaped is positioned around the reinforcement bar and its ends are pressed together by the reinforcement specialist. The base is then fitted over the screw resulting from the two ends of the clamping element which has been brought together and is screwed on until the spacer firmly encircles the reinforcement bar. Then the base is positioned so that its axis of symmetry is perpendicular with respect to the casing.

Considering the fact that in the course of producing a reinforcement for a concrete construction, the reinforcement specialists normally use steel-wire connections for the mutual support of neighboring reinforcement bars, the mounting of the spacers according to the invention proves to be a simple operation, which can be performed without the need for additional tools. The fitting of the clamping member on a reinforcement bar and its tightening with the base is an operation which can be performed easily and quickly.

The base itself can be produced as a body of plastic material through an injection molding process. The socket can also be cast in concrete and shaped with a hump at its frontal side opposite the threaded bore, so that at least three humps are defined in a plane running perpendicularly to its plane of symmetry.

Such sockets cast in concrete have the advantage that they can also be used in the production of exposed concrete, without influencing the appearance of the outer concrete surface.

An injection-molded hollow body made of plastic material or metal and provided with the threaded bore can be axially introduced into such a base cast in concrete. This can be done by casting this socket in a die wherein prior to the casting the hollow body of plastic material or metal provided with an external ribbing has been suspended. The ribbing is necessary in order to prevent a twisting of the hollow body inside the socket while the reinforcement bar is fastened.

It is further advisable to conically enlarge the upper rim of the threaded bore, in order to insure a better tightening of the socket during the connection process.

Suitably as a thread for the hollow body a metric isotrapezoidal thread with a 14 mm thread diameter is selected.

The clamping element meant to be positioned around the reinforcement bar is suitably also provided with internal ribbing. Its two ends are provided with holding pins and corresponding holes, in order to make possible the mutual fastening of these ends after the clamping of the reinforcement bar.

This clamping member can also be produced in a modified embodiment, so that its two ends in their mutually overlapping position form a complete screw fitted to the inner threading of the hollow body. Thereby the two screw halves can be inserted into each other as mortise and tenon.

To the upper side of the closed clamping member suitably lateral wings are attached, which serve for the rectangular orientation of the clamping members positioned on crossing reinforcement bars, thereby also serving the entire spacer.

A spacer according to the invention can be used for reinforcement bars of any diameter. It only necessary to provide clamping members of various sizes for the normally used reinforcement rods with a diameter of 6 to 24 mm. The various clamping members must have then a corresponding inner diameter.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
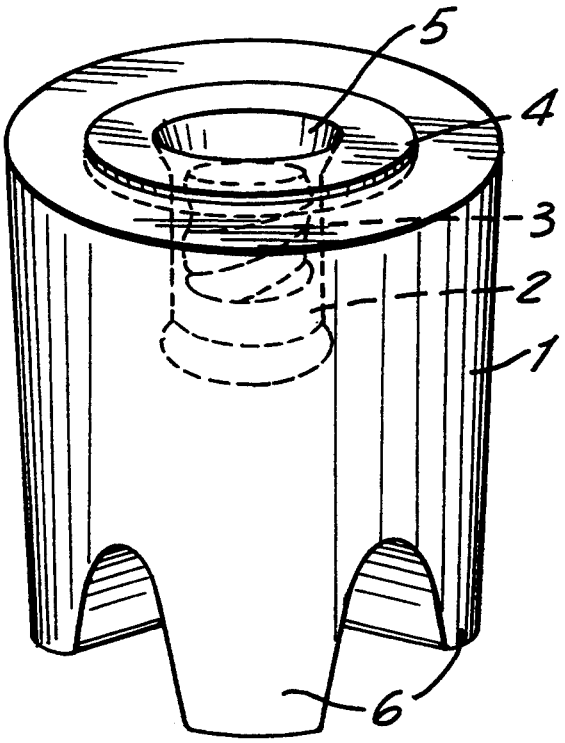
FIG. 1 shows a base for a spacer in a perspective view.

The base of FIG. 1 is made of concrete. It has on its lower end three hump-like parts 6, which are meant to rest against the framework after the base is fastened to a reinforcement bar. In the upper end side of this base 1 a hollow body 2 made of plastic material or metal is inserted, which is produced through an injection molding process and has an internal thread 3. The threaded bore 3 of this hollow body 2 ends on its upper side in a conical enlargement 5. The base 1 has a step 4, so that the reinforcement bar 7 pressed against the socket 1 when screwed together with the clamping member 8, rests only against this projection 4.

Figure 4:
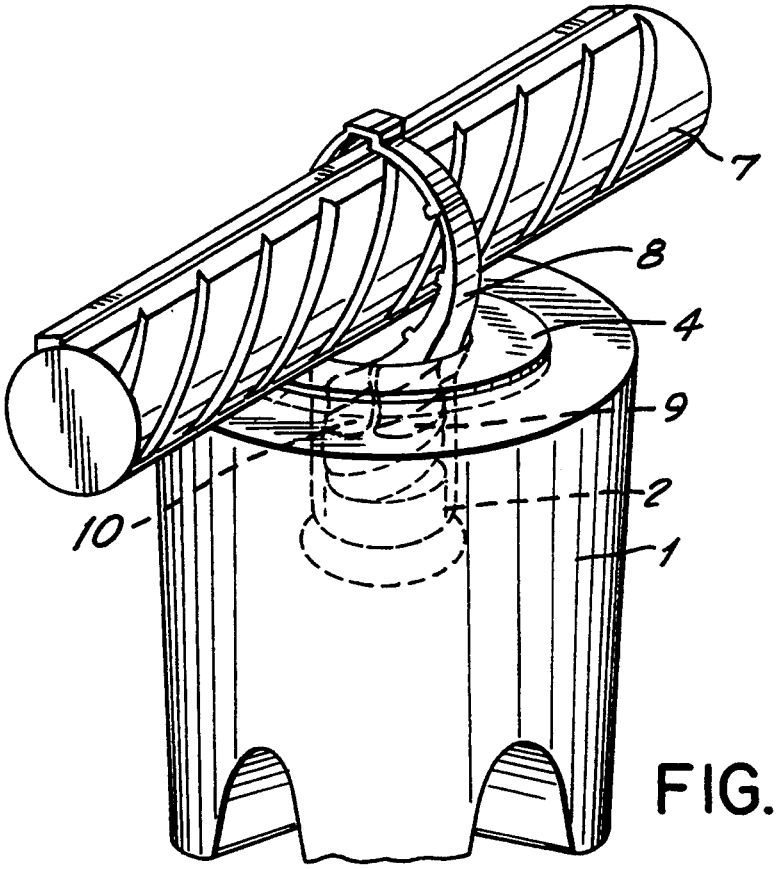
FIG. 4 shows the fastening of a reinforcement bar by means of the two parts pertaining to the spacer in a perspective view.

The clamping member 8, which is equipped with the inner ribbing 12, has an inner diameter which corresponds approximately with the diameter of the reinforcement bar 7. Its ends 9 and 10 when brought together in the tightened state of this clamping member form a screw 13, provided with a threading which corresponds with that of the threaded bore 3 of the socket. In order to insure that during the clasping of the reinforcement bar 7 the two ends 9 and 10 of the clamping member are precisely positioned on each other, in one of these ends one or more holding pins 11 and corresponding holes in the other end are provided. When the clamping member 8 is pressed together, these pins 11 engage in the holes. The fastening of the spacer now takes place simply by screwing the base 1 onto the screw formed by the two ends 9 and 10 of the clamping member 8. After this procedure, the reinforcement bar is firmly clasped by the spacer, so that a mutual sliding or tilting is no longer possible. This situation is illustrated in the perspective view of FIG. 4.

Figure 3:
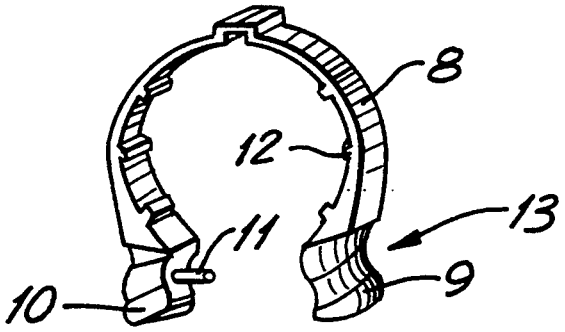
FIG. 3 shows a clamping member for fastening the reinforcement bar on the socket in an exploded view.
Figure 2:
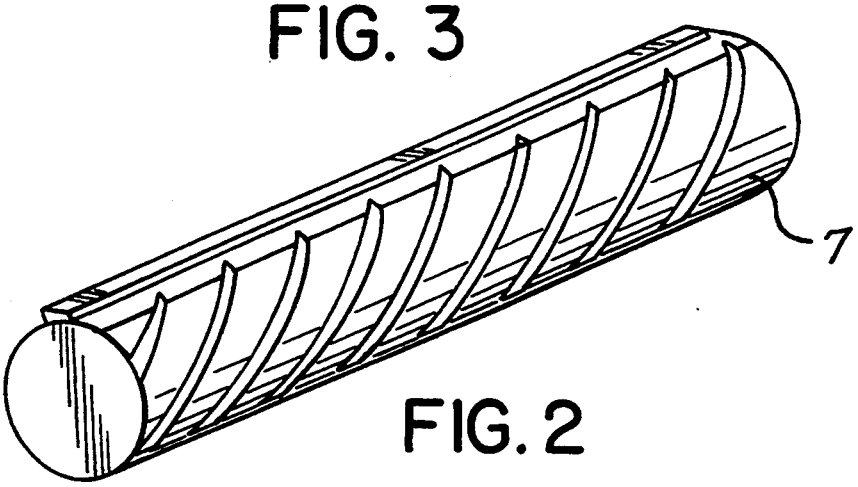
FIG. 2 shows a reinforcement bar prior to clamping, also in a perspective view.
Figure 5:
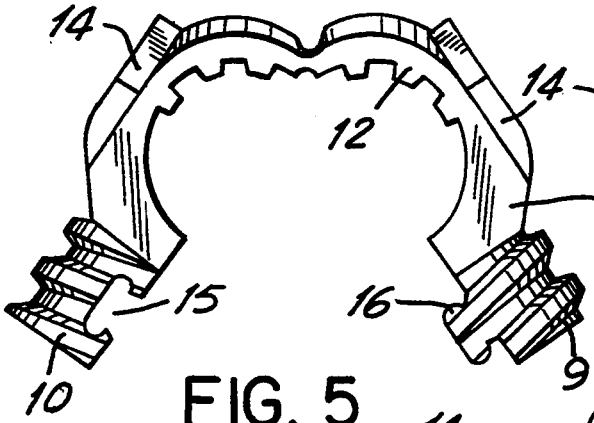
FIGS. 5 to 7 are respectively a side view of the open clamp, a perspective view thereof and a side view of the spacer in another embodiment.
Figure 6:
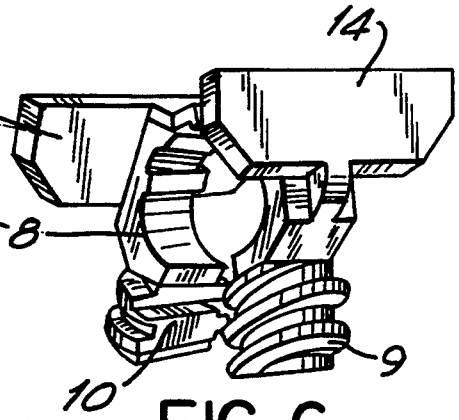
Figure 7:
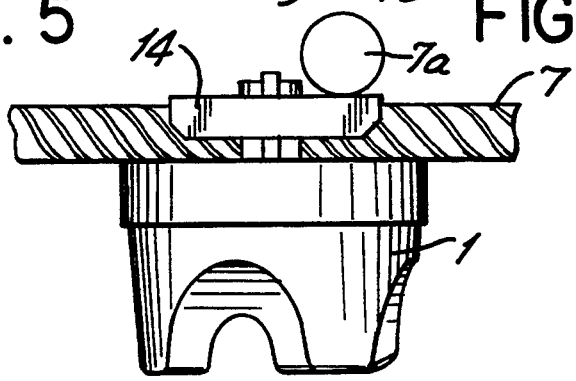

The embodiment of the clamping member 8 shown in a perspective view in FIGS. 5 and 6 differs from the embodiment of FIG. 3 because of the different configuration of the two ends 9 and 10, which here in the closed state of the clamping member 8 form a complete threaded screw. The cohesion of these two ends is achieved by mortise and tenon 15, 16 which engage in each other The attached wings 14 serve for the simple perpendicular orientation of the clamping member 8 fitted over crossing reinforcement bars 7 7*a*, as can be seen from FIG. 7.

In all embodiments of the spacer bases of concrete or plastic material can be used. Plastic material is more appropriate for interior spaces because of its light weight; concrete sockets are used as a rule for outer casing works.

As already mentioned the base 1 can be used in connection with clamping members 8 of various diameters, so that practically all existing diameters of reinforcement bars can be equipped with this spacer.

We claim:

1. A spacer for a reinforcement bar to be embedded in concrete, comprising:

a band-shaped clamping member configured to encircle a reinforcement bar and provided at opposite ends with respective screw parts having inner faces and outer faces with screwthread formations, said clamping member having a flexibility enabling said screw parts to be brought together with said inner faces juxtaposed with one another upon said clamping member encircling said bar as a ring, whereby said screw parts form a screw and said formations constitute an external screwthread; and a base formed at one end with an internally threaded bore receiving said screw and with an internal screwthread mating with said external screwthread, whereby threading of said screw into said bore and said base onto said clamping member clamps said member against said bar.

2. The spacer defined in claim 1 wherein said base is formed of cast concrete and has, at another end opposite said one end, at least three spaced apart humps in a plane perpendicular to a vertical axis of said base.

3. The spacer defined in claim 1 wherein said base comprises a body of circular cross section composed of concrete and, embedded in said body, an insert body of plastic or metal and formed with said bore.

4. The spacer defined in claim 1 wherein said bore has a conically enlarged rim facing said clamping member.

5. The spacer defined in claim 1 wherein said internal screwthread is a metric isotrapezoidal thread with a thread diameter of 14 mm.

6. The spacer defined in claim 1 wherein one of said inner faces has a pin projecting therefrom, the other of said inner faces receives said pin, and said pin fastens said screw parts together upon said clamping member encircling said bar.

7. The spacer defined in claim 1 wherein said inner faces are provided with mating mortise and tenon formations for securing said screw parts together.

8. The spacer defined in claim 1 wherein said clamping member is formed with internal ribbing engageable with said bar.

9. The spacer defined in claim 1 wherein said clamping member is dimensioned to fit around a reinforcement bar with a diameter of 6 to 24 mm.

10. The spacer defined in claim 1 wherein the clamping member has two laterally attached wings to enable perpendicular orientation of two reinforcement bars crossing one another.

* * * * *